US008251262B2

(12) United States Patent
Peckels

(10) Patent No.: US 8,251,262 B2
(45) Date of Patent: Aug. 28, 2012

(54) VOLUME METERED POUR SPOUT

(76) Inventor: Timothy Peckels, Braham, MN (US)

( * ) Notice: Subject to any disclaimer, the term of this patent is extended or adjusted under 35 U.S.C. 154(b) by 530 days.

(21) Appl. No.: 12/462,967

(22) Filed: Aug. 12, 2009

(65) Prior Publication Data

US 2011/0036873 A1 Feb. 17, 2011

(51) Int. Cl.
*B65D 47/00* (2006.01)

(52) U.S. Cl. ..... 222/476; 222/1; 222/477; 222/481.5; 222/500; 222/566; 222/567; 222/569

(58) Field of Classification Search ..... 222/1, 442, 222/456, 476–479, 481–482, 500, 566–567, 222/569, 504, 556, 562, 563, 67–69, 481.5
See application file for complete search history.

(56) References Cited

U.S. PATENT DOCUMENTS 3,321,113 A * 5/1967 Conry ..... 222/477
5,044,521 A * 9/1991 Peckels ..... 222/23
5,255,819 A * 10/1993 Peckels ..... 222/1
5,961,008 A * 10/1999 Peckels ..... 222/477
6,233,797 B1 * 5/2001 Neely et al. ..... 28/115
6,409,046 B1 * 6/2002 Peckels ..... 222/1

* cited by examiner

*Primary Examiner* — Frederick C. Nicolas
(74) *Attorney, Agent, or Firm* — D L Tschida

(57) ABSTRACT

A pour spout including a liquid metering orifice and a reciprocating control valve assembly mounted to prevent "blocked", "short shot" and "free pour" conditions. The control valve assembly controls a pressure differential to restrain and release a primary flow valve piece. Weight pieces are included at alternative shutter-acting control valve pieces. Other electromechanical and/or electromagnetic and/or permanent magnet control valve assemblies are disclosed. A molded pour spout is also provided having a check ball mounted for reciprocating movement between a plurality of integral ribs that project into a longitudinal flow path. An improved vent assembly is also provided to maintain the pour accuracy with progressively decreasing liquid volume.

28 Claims, 7 Drawing Sheets

VOLUME METERED POUR SPOUT

BACKGROUND OF THE INVENTION

The present invention relates to a liquid pouring spout and, in particular, to a volume metering pour spout wherein the exposure of a metering orifice is temporarily sealed at the start of a pour to assure an accurate pour of a predetermined volume of liquid without spillage, "blocked", "short shot" and/or "continuous pour" conditions.

Numerous types of mechanical, electromechanical and electrically controlled pour spouts or liquid pourers have been developed to dispense liquids. Pressurized, hand controlled dispensing systems are also commonly used in commercial settings that couple to several remotely located bottles.

The subject pourers are individually fitted to liquor bottles and used to manually dispense the contained liquids upon tipping the bottles. Some pourers merely provide a spout to facilitate pouring without spillage. More sophisticated pourers dispense liquid in metered volumes ranging from ¾ ounce to 3 ounces. The pourers are secured to the container with a liquid tight seal and can include features to prevent the exposure of the liquid to the air, dust, insects and other environmental contaminants.

The manual pourers are primarily designed to dispense liquor, although some are used to dispense a variety of other liquids. For example, pourers are used by chefs to dispense cooking oils, wines, water or any other cooking liquids. Persons involved in other occupations that require the frequent dispensing of bottled liquids may also use a manual pourer. These pourers may or may not provide metering and may or may not include cap pieces to cover a spout orifice.

Metered pourers are constructed to dispense a predetermined quantity or volume of liquid upon tipping a bottle fitted with the pourer. As the bottle is tipped a liquid control assembly permits the liquid to flow from an included spout until a predetermined volume is dispensed. The pourer then shuts off liquid flow, until the bottle is returned to an upright condition and any liquid in the flow path is returned to the bottle.

Some mechanically metered, prior art pourers of generally similar construction to the present invention that are particularly known to applicant are shown at U.S. Pat. Nos. 5,044,521 and 5,961,008. The latter pourers utilize multiple ball valves or check balls (e.g. ball bearings) and associated valve seats to hydraulically control the volume of liquid dispensed by the pourer. The '521 patent provides for a two-ball pourer and the '008 patent provides for a three-ball pourer.

A metering orifice formed into the longitudinal dump cap sidewall of the foregoing '008 and '521 pourers admits liquid into the pour path downstream of a primary check ball to control movement of the check balls to determine the volume of liquid dispensed. A greater volume of liquid is dispensed as the area of the metering aperture is reduced. The forward, primary check ball controls primary liquid flow and an aft, dump check ball at a so called "dump valve" controls the evacuation of liquid from a center flow conduit. A third, vent check ball cooperates with a bottle vent orifice to prevent liquid dripping from the spout as the bottle is returned to an upright condition.

Depending upon the hand movements of a user (e.g. bartender), the foregoing pourers can be induced to several undesired conditions that overcome the metering control. That is, a sharp, rapid tipping movement can throw the primary check ball off a rear valve seat to prematurely engage a forward valve seat in the primary flow conduit to "block" or prevent liquid from being poured. Alternatively, the exaggerated movement can permit some flow but produce an abbreviated pour time and result in a "short shot" condition. A less exaggerated or slow tipping action can occasionally cause the primary check ball to remain seated to the aft valve seat and produce a "continuous pour" condition. Liquid is then dispensed continuously without any metering so long as the bottle remains tipped with the primary check ball stuck and a supply of liquid is available to flow through the flow spout.

The present invention was developed to provide an improved volumetrically controlled pourer. The pourer was particularly designed to dispense an accurately metered volume of liquid in a construction that minimizes the possibility of undesired "blocked", "short shot" and "free pour" conditions. The pourer in several embodiments provides a novel valve assembly and mechanism for controlling a pressure gradient or pressure differential between upstream and downstream sides of a primary valve member. For a period of time at the start of each pour, the assembly restricts liquid and air flow downstream of the primary valve member to restrain the valve member to its seat. The restricted flow acts in a fashion similar to holding a finger over one end of a liquid filled straw. Until the present control member is released, liquid is prevented from entering or flowing out of the straw or primary flow channel. In various alternative pourers, the assembly temporarily controls or blocks the exposure of alternative longitudinal and/or radially directed metering orifices and/or liquid control orifices to liquid flow and thereby temporarily restrains movement of a primary check ball.

In one presently considered construction, a metering orifice is arranged as part of a longitudinally reciprocating, metering assembly fitted to the pourer downstream of a primary check ball. A reciprocating tubular valve body mounted in a "dump cap" housing contains a forward valve surface and a concentric metering orifice. Several associated, radially directed liquid control orifices are formed in the sidewalls of the valve body. A weighted, tubular member is separately supported in the valve body for reciprocating movement with pourer movement to contemporaneously seal and expose the liquid control orifice(s).

The weight member seals the liquid control orifices and produces a negative pressure condition at the metering orifice (in the fashion of a finger over a filled straw) and downstream of the primary check ball (versus the upstream side of the primary check ball) to prevent premature release of the primary check ball. Once the weight member moves past the liquid control orifices, liquid flow through the metering orifice releases the primary check ball valve. "Blocked", "short shot" and "free pour" are thereby prevented conditions.

An alternative pourer assembly supports a valve body downstream of a primary check ball in a dump cap housing having a forward valve surface and a longitudinal metering orifice. The valve body reciprocates to and fro, without a weight piece, to control movement of primary check ball.

Other alternative volumetric metering assemblies provide control mechanisms that cooperate with one or more radially directed (relative to a longitudinal flow axis) metering orifice(s) formed through the sidewalls of a longitudinal liquid flow tube or dump cap. The control assemblies temporarily cover the metering orifice(s) to prevent premature movement of a primary check ball. Several alternative electromechanical, magnetic and/or electromagnetic and/or manual cover pieces that cover the metering orifice are disclosed. Appropriate reciprocating, pivoting or rotating movement of each cover piece from a covered to uncovered condition at the start of each pour, exposes the sidewall metering orifice to normal liquid flow to release a primary check ball.

Air flow through associated vent tubes in the subject pourers is also improved. Relatively long tapered vent chamber walls downstream of a forward vent seat regulate air flow past the vent ball relative to the decreasing volume of liquid in the container. As the volume declines, the tapered walls allow the vent ball to remain unseated longer than with prior art pourers to maintain the primary liquid flow and assure a constant volume delivery with each pour over the life of a bottle. The improved vent tube structure can be used alone or in combination with the other improvements of the invention.

Alternative novel spout cover assemblies are also disclosed that can be incorporated into the presently improved pourers alone or in combination to seal the primary flow path from contaminants when the bottle is stored upright. The spout cover assemblies can also be combined with other metered or un-metered pourers.

SUMMARY OF THE INVENTION

It is a primary object of the invention to provide a liquid pourer for dispensing liquids without "blocked", "short shot" and "free pour" conditions.

It is further object of the invention to provide a pourer containing a primary flow control valve and the movement of which is temporarily restricted by controlling a pressure gradient across or between upstream and downstream sides the flow control valve.

It is further object of the invention to provide a pourer having a metering orifice and a control assembly for regulating pressure and liquid flow at the metering orifice and downstream of a primary flow valve to temporarily restrict movement of the primary flow valve.

It is further object of the invention to provide a pressure control assembly for a pourer metering orifice comprising a tubular valve body mounted for reciprocating movement and including a separately mounted valve piece that controls the exposure of a plurality of air flow control orifices that regulate pressure and/or liquid flow to the metering orifice to temporarily restrict movement of a check ball valve.

It is further object of the invention to provide a pourer containing at least one check ball valve and wherein a tubular valve body mounted downstream of the check ball has a longitudinal metering orifice mounted for reciprocating movement and includes a relatively heavy weight valve piece mounted to cover and uncover at least one liquid/air control orifice to regulate pressure and/or liquid flow to the metering orifice to temporarily restrict movement of the check ball valve.

It is further object of the invention to provide a pourer containing a primary check ball valve in a flow conduit and mounted to cooperate with a metering orifice control valve assembly mounted downstream of the check ball valve and comprising a tubular valve body having a valve surface and a longitudinal metering orifice and means for controlling the pressure and liquid flow to the metering orifice to temporarily restrict movement of the check ball valve.

It is further object of the invention to provide a pourer containing a primary check ball valve in a flow conduit and mounted to cooperate with a metering orifice control valve assembly mounted downstream of the check ball valve and comprising a tubular valve body having a longitudinal metering orifice and including a separately mounted, weighted tubular valve piece that controls the exposure of a plurality of radially directed liquid flow control orifices that regulate pressure and liquid flow to the metering orifice.

It is further object of the invention to provide a pourer having a flow control valve and a volumetric metering orifice located downstream of the check ball valve that cooperates with an electromagnetically controlled valve piece that covers the metering orifice to control the exposure of the metering orifice to temporarily restrict liquid flow through the metering orifice and movement of the flow control valve.

It is further object of the invention to provide a pourer having a flow control valve and a volumetric metering orifice mounted downstream of the flow control valve that cooperates with a longitudinally directed cover piece that covers the metering orifice to control the exposure of the metering orifice to temporarily restrict liquid flow through the metering orifice and movement of the flow control valve.

It is further object of the invention to provide a pourer having a flow control valve and a volumetric metering orifice mounted downstream of the flow control valve that cooperates with a rotationally directed cover piece (e.g. disk) that covers the metering orifice to control the exposure of the metering orifice to temporarily restrict liquid flow through the metering orifice and movement of the flow control valve.

It is further object of the invention to provide a pourer having a flow control valve and a volumetric metering orifice mounted downstream of the flow control valve that cooperates with a center-opening cover that covers the metering orifice to control the exposure of the metering orifice to temporarily restrict liquid flow through the metering orifice and movement of the flow control valve.

It is a further object of the invention to provide a pourer vent tube construction wherein a chamber that supports a vent ball exhibits tapered walls downstream of a forward valve seat to enhance regulation of air flow past a vent valve piece with decreasing liquid volume.

It is a further object of the invention to provide a pourer that includes a pour spout cover assembly comprising a check ball mounted between a cap piece and a plurality of integral ribs that project from the flow conduit into the flow path and/or a screened cap piece that also includes integral ribs.

The foregoing objects, advantages and distinctions of the invention are obtained in several alternative pourer assemblies disclosed herein, among many other assemblies. In one presently considered construction, an improved "dump cap" housing is fitted with a reciprocating valve body having a longitudinal metering orifice and supporting a reciprocating, heavy weight liquid control valve piece downstream of a primary check ball. The valve body controls liquid flow though the metering orifice and a pressure gradient across or between upstream and downstream sides of the check ball to temporarily restrict movement of the check ball and prevent "blocked", "short shot" and "free pour" conditions.

The reciprocating valve body particularly provides a circular, tapered valve surface, a longitudinal, concentric metering orifice, and several cooperating liquid/air control orifices. A weighted member (e.g. metal or relatively heavy weight material exhibiting a tubular, spheroid, ellipsoid or other solid or hollow shape) is separately supported in the valve body for reciprocating movement with pourer movement to cooperatively seal and expose liquid control orifice(s) to regulate liquid flow through the orifices and to the metering orifice and thereby a pressure at the metering orifice downstream of the primary check ball to temporarily restrict movement of the primary check ball.

An alternative pourer assembly supports a valve body in a "dump cap" housing downstream of a primary check ball having a tapered forward valve surface and a longitudinal metering orifice that is mounted for reciprocating longitudinal movement to control movement of a primary check ball.

Other alternative volumetric metering assemblies provide pressure control assemblies on the downstream side of a primary check ball valve that cooperate with radially directed metering orifice(s) formed in the sidewalls of a longitudinal liquid flow conduit. The alternative assemblies alternately cover and expose the metering orifice(s) to normal liquid flow to control primary check ball movements. Electro-mechanical and/or electromagnetic controlled valve pieces are disclosed that in one pourer control a longitudinally directed valve/cover piece; that in another pourer control a rotating valve/cover piece; and that in a third pourer control a center-opening valve/cover piece and all of which control the exposure of the metering orifice to liquid flow to regulate movement of a primary flow valve piece (e.g. check ball).

Pourers with improved vent tubes are also disclosed that operate to maintain the repeatable accuracy of each pour as the liquid volume decreases over the life of the bottle. A vent ball support chamber is provided downstream of a forward vent ball seat having shallow tapered walls that prolong the period before the vent ball seats as the volume decreases in the bottle. Pour accuracy is thereby maintained over the life of the bottle.

A check ball spout cover is also disclosed that can be integrated into a pour spout. The cover permits reciprocating movement of a check ball between a plurality of ribs that integrally project into a longitudinal flow path of the spout and a cap piece. The cap piece can provide a grilled or mesh-like surface. The ribs at the spout bore and cap piece are configured to define valve seats for the spout check ball. The spout cover can be integrated into a pourer with or without a check ball.

Still other objects, advantages, distinctions, constructions and combinations of individual features of the invention will become more apparent from the following description with respect to the appended drawings. Similar components and assemblies are referred to in the various drawings with similar alphanumeric reference characters. In addition to the several alternative pourer constructions, the various singular features can be arranged in other combinations. The description to each presently considered combination should not be literally construed in limitation of the invention. The invention should instead be interpreted within the broad scope of the further appended claims.

DESCRIPTION OF THE PREFERRED EMBODIMENTS

Figure 1:
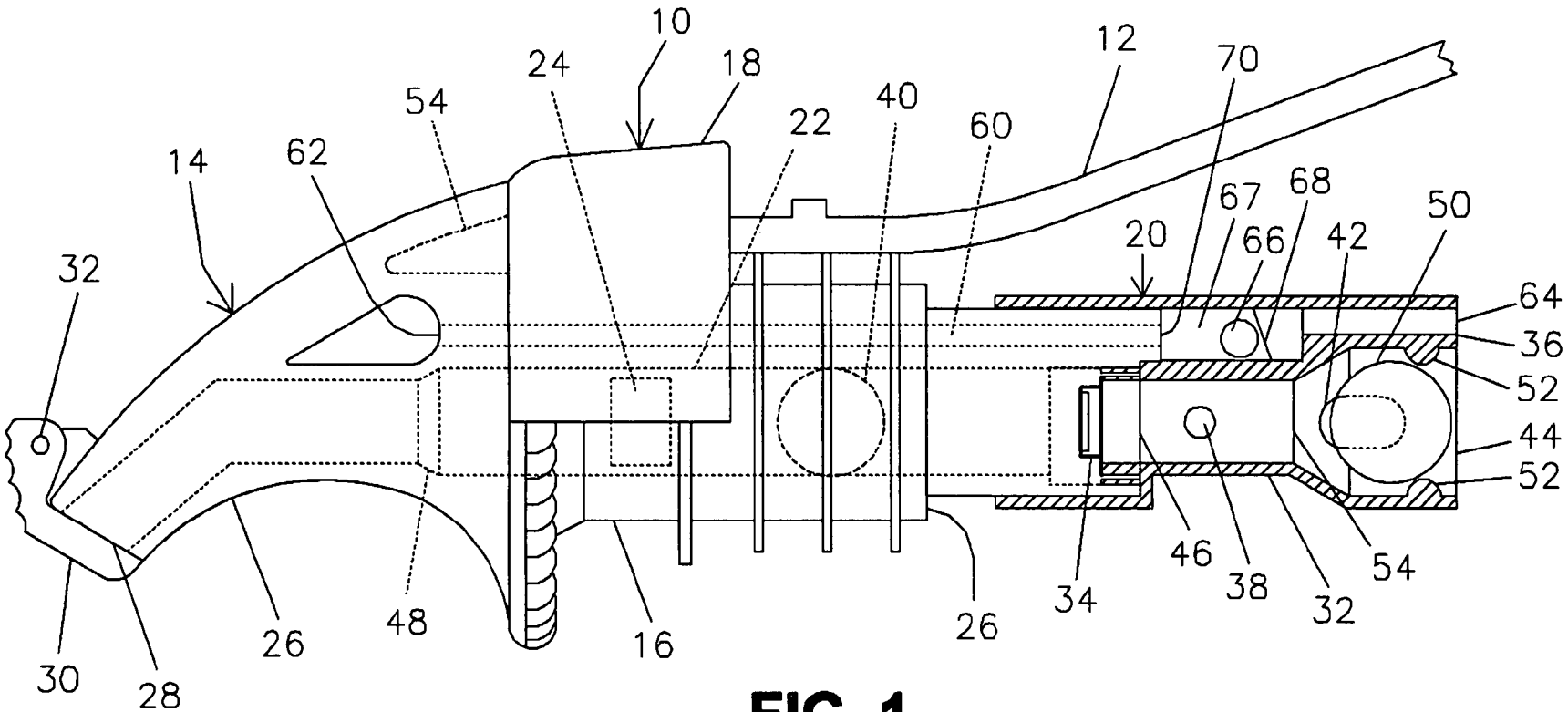
PRIOR ART FIG. 1
FIG. 1 shows a longitudinal, partially sectioned view to a prior art volumetric metering pourer wherein liquid flow is hydraulically controlled with a plurality of check balls.

With attention to FIG. 1, a prior art pourer or pour spout 10 is shown that is more fully described at U.S. Pat. No. 5,961, 008. The pourer 10 generally mounts to a bottle 12 or other liquid container. A main body 14 is molded from a suitable plastic(s) and provides a sealing cork 16, an optional collar 18, and a liquid flow conduit 20. The flow conduit 20 includes a longitudinal, primary flow bore 22 that is exposed to liquid and air flow via several ports. A primary fill port 24 is located in a channel space 26 between the cork 16 and conduit 20. Liquid that enters the port 24 is directed via the bore 22 to a spout 27 and outlet port 28.

A hinged cover flap 30 is secured to pivot relative to the spout 27 at a hinge pin 32. When the bottle 12 and pourer 10 are supported upright, the flap 30 covers the outlet port 28 and liquid contents to external contaminants (e.g. air, dust, insects or the like). During pouring, the cover flap 30 pivots away from the port 28 to permit the discharge of liquid.

Included at the aft end of the conduit 20 is a so called dump cap housing 32, shown in longitudinal cross section. The dump cap housing 32 is detachably secured in a suitable fashion, for example with a number of resilient fasteners 34 that interconnect the dump cap housing 32 to the conduit 20. The fasteners 34 can comprise mating projections and/or recesses. Alternatively the dump cap housing 32 can be secured with suitable adhesives, welding or the like. The dump cap housing 32 provides a longitudinal bore 36 that coaxially aligns with the primary flow bore 22. One or more liquid metering ports or orifices 38 extend through the sidewall of the dump cap housing 32 to control the volume of liquid dispensed by the pourer relative to the movement of a primary check valve piece or ball 40. The metering orifice 38 is normally exposed to the air and liquid flow in the bottle and primary bore 22. Lateral windows 42 are formed into the sidewalls of the dump cap housing 32 and an aft port 44 is aligned to the bore 36 and communicates with the primary flow bore 22.

During a normal tipping action of the bottle 12 and pourer 10, a primary check valve piece or check ball 40 travels from an aft seat 46 at the dump cap housing 32 to a forward seat 48 at the spout 26, located forward of the primary fill port 24. When the bottle 12 is upright, the check ball 40 rests at the seat 46 and migrates to the forward seat 48 under a hydraulic pressure and control determined by the metering orifice 38 and air flow into the bottle 12 via the vent and liquid flow from the bottle 12 and pourer 10 as the bottle is tipped to dispense liquid. The duration of the migration of the check ball 40 determines the volume of liquid dispensed. Nominal volumes in the range of ¾ to 3 ounces are typically dispensed with suitably sized orifices 38 at the pourer 10. The volume is primarily determined by the exposed area of the orifice 38 such that the larger the area of the orifice 38, the less liquid dispensed.

A second check valve or check ball 50 is supported in the dump cap housing 32 and moves between aft limit stops (e.g. molded projection(s) 52 and a forward seat 54 formed into the dump cap housing 32). The check ball 50 reciprocates back and forth in the dump cap housing 32 and restricts/seals off air and liquid flow from the dump cap housing 32 into the bore 22 as liquid is supplied to the forward primary fill port 24. The metering orifice(s) 38 thus controls the liquid and air pressure behind the check ball 40 during normal tipping rotations of the bottle 12. As the bottle is returned to an upright condition and the check balls 40 and 50 are disengaged from the forward seats 48 and 54, liquid trapped in the flow bore 36 aft of the check ball 40 passes or is "dumped" from the bore 36 through the windows 42 and aft port 44 into the bottle 12.

Displaced laterally and extending longitudinally parallel to the primary flow bore 36 at the conduit 20 is a vent bore 60. The vent bore 60 is exposed to the external environment and air at a port 62 in the spout 27 and is exposed to the bottle interior at an aft port 64. A vent check valve or check ball 66 is retained in a straight walled chamber 67 of the dump cap housing 32 between an aft seat 68 and a forward seat 70. The forward seat 70 provides a relatively abrupt seating surface.

As liquid is evacuated from the bottle, air enters the bottle via the port 62 and vent bore 60 with sufficient pressure to prevent the vent check ball 66 from seating. As the primary check ball 40 eventually seats at valve seat 48, the vent ball 66 seats to the forward seat 70.

During a normal tipping motion of the bottle 12, the vent check ball 66 reciprocates between the seats 68 and 70 to prevent liquid flow from the vent bore 60. As liquid is evacuated, air flow through the vent bore 60 prevents the check ball 66 from seating. Once seated at the forward seat 70, the closure of the vent bore 60 produces a pressure differential between the upstream and downstream sides of the primary check ball 40 that prevents dripping from the spout 27 and port 28. As the bottle is tipped back upright and the primary check ball 40 returns to the aft seat 46, dripping is prevented due to gravity as the bottle angle changes.

A problem that has been noted with the pourer 10 is that as the volume of liquid diminishes in the bottle and the air pressure in the vent bore 60 lessens, a slight decrease in the pourer metering accuracy occurs. To alleviate this loss of accuracy, the pourers of the present invention have been improved by forming extended, shallow angle tapered walls in the bore 60 downstream of the seat 70 which delay the seating of the vent check ball 66, and the details of which are discussed in greater detail below.

Although the pourer 10 of FIG. 1 has proven very accurate and reliable, conditions can occur where the physical actions of a user (e.g. bartender) can compromise the operation of the pourer 10. That is, occasionally when the user tips the bottle 12 very slowly, liquid tension, hydraulic or pneumatic adhesion, vacuum and/or other mechanical forces can cause the check ball 40 to stick or remain seated to the aft seat 46. This places the pourer 10 in a "free pour" condition and liquid can continuously pour without any regulation. Alternatively, if the user vigorously tips, whips or throws the bottle forward with an exaggerated hand motion, the primary check ball 40 can be made to snap into contact with the forward seat 48 before any liquid pours and all liquid flow via the primary flow bore 22 is "blocked". If a slightly less exaggerated tipping force is applied, a "short shot" condition can occur. A "short shot" occurs when the check ball 40 is prematurely dislodged from the seat 46 and an amount of liquid less than the metered amount is dispensed.

The pourers of the subject disclosure shown at FIGS. 2 through 23 and described below have been improved to overcome the nuisance "continuous pour", "blocked" and "short shot" conditions. The subject pourers particularly control a pressure gradient between the upstream and downstream sides or the check ball 40 that controls the release of the check ball 40 from the aft seat 46. The check ball in particular is temporarily restrained at the start of each pour by creating a negative pressure or restricted liquid flow condition downstream of the check ball. The liquid flow path on the downstream side in particular is briefly blocked in a fashion similar to placing a finger over the end of a filled straw to prevent filling or leakage from the straw. The condition persists for a period sufficient to allow liquid to enter the primary flow path, when normal downstream pressure and liquid flow is returned to being at least equal to the upstream pressure and the check ball is freed to move and regulate the liquid flow.

Figure 2:
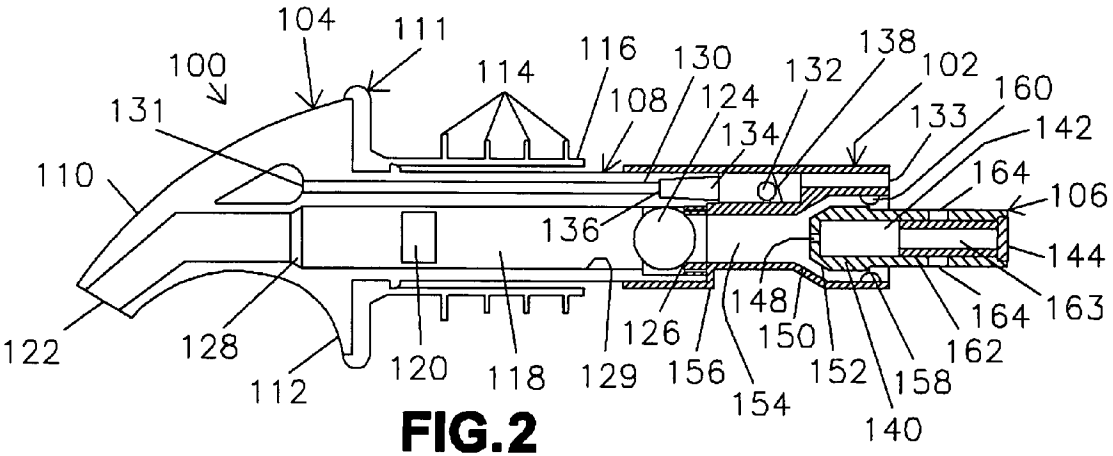
FIG. 2 shows a longitudinal side view to a pourer of the invention supporting an improved dump cap shown in partial cutaway with a metering orifice control valve body and primary and vent check balls retracted.
Figure 3:
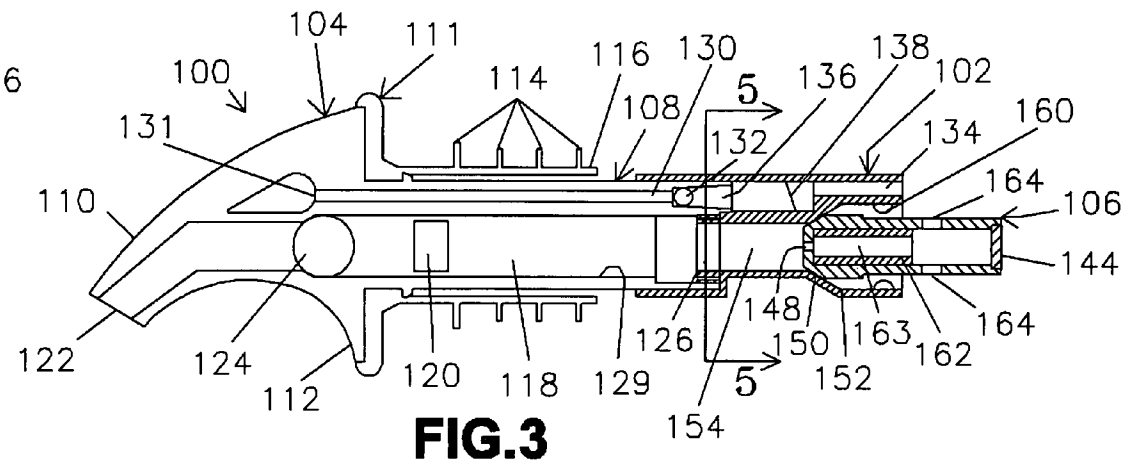
FIG. 3 shows a longitudinal side view to the pourer of FIG. 2 with the metering orifice control valve, weight piece and primary and vent check balls seated to forward valve seats.
Figure 5:
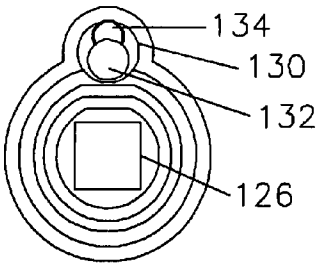
FIG. 5 shows a cross section view through the pourer of FIG. 3 taken along section lines 5-5.

Turning attention to FIGS. 2 and 3, longitudinal views are shown to a pourer 100 having an improved dump cap metering assembly 102 that supports a novel reciprocating, metering valve piece assembly 106. The valve assembly 106 is shown removed and in exploded assembly in FIG. 4. FIG. 5 shows a cross section view through the dump cap assembly 102 taken along section lines 5-5. The pourer 100 comprises a body 104 that includes a primary flow conduit 108 and spout 110 which are integrally molded as one-piece from a suitable plastic. The body 104 could be molded from multiple pieces.

A resilient sealing member or cork 111 is fitted over the flow conduit 108 and fastened to a flange 112 that radiates from the aft end of the spout 110. Projecting fins 114 radiate from the cork 111 to seal the pourer 100 to a bottle (not shown). Tubular, longitudinal aft end walls 116 of the cork 111 are laterally displaced from the primary flow conduit 108 and extend generally parallel such that a flow path is defined between the walls 116 and conduit 108.

Upon rotating or tipping a bottle (not shown) that supports the pourer 100 approximately horizontal or past horizontal, liquid flows between the tubular wall 116 and outer surface of the flow conduit 108 to enter a primary flow bore 118 at one or more inlet ports 120 formed through the wall 116. The flow bore 118 extends the length of the conduit 108 and through the spout 110. Liquid flows through the bore 118 and spout 110 and is dispensed at a forward outlet port 122. Upon tipping or rotating the pourer 100 upright or vertical, liquid returns through the flow bore 118 and pourer 100 to the bottle.

The volume of liquid dispensed is determined by the cooperation of the improved dump cap metering assembly 102 and a primary check valve piece or check ball 124. The primary check ball 124 is mounted in the primary flow bore 118 and travels between a rear seat 126 defined at a fore end of the dump cap metering assembly 102 and a forward sealing surface or seat 128 formed into the spout 110. The rear seat 126 is shown in detail at the section view of FIG. 5 and is constructed to permit liquid to pass back and forth through the dump cap metering assembly 102. Presently the seat 126 exhibits a raised square shape although can exhibit a variety of other shapes.

The movement of the check ball 124 is primarily regulated by the improved metering valve assembly 102 described in more detail below. A raised projection or dimple 129 also projects into the bore 118, slightly forward of the check ball 124, to retard movement of the ball 124 and enhance the tipping angle (e.g. 10° to 20° past horizontal) before the ball 124 is normally released. A small depression or other obstruction could be provided to similar effect. Movement of the check ball 124 is also temporarily restrained due to the action of the improved metering valve assembly 102.

A vent bore 130 generally extends parallel to the primary flow bore 118. A fore end 131 of the bore 130 is exposed to the external environment at the spout 110 and an aft end 133 is exposed to the bottle interior to vent the interior of the bottle. A vent check valve piece or check ball 132 is supported in an elongated, shallow tapered bore space or chamber 134 formed into a portion of the vent bore 130 adjacent the coupling of the dump valve assembly 102 to the flow conduit 108. The vent check ball 132 is contained to move between a forward seat 136 and an aft surface or seat 138 and operates to generally prevent liquid from dripping from the dispensing port 122 at the end of a pour.

The action of the check ball 132 has been improved in the pourer 100 to maintain the repeatability of the dispensing accuracy of the pourer 100 as the liquid volume diminishes over the life of a bottle. Previously, it was noticed that the accuracy of each pour diminished as the liquid volume in the bottle progressively decreased due to a premature seating of the check ball 132 to the seat 136. The tapered bore space 134 prevents premature seating. As the volume of contained liquid now decreases and the air pressure of the air rushing through the vent bore 130 diminishes, the ball 132 is suspended longer before seating substantially contemporaneously with the primary ball 124 at seat 128. That is, as liquid is drained from the bottle, the tapered bore space 134 maintains and controls the suspension of the check ball in the tapered column 134 in a self-regulating fashion before seating at seat 136. The duration of the suspension time before the ball seats at seat 136 is believed to increase due to a prolonged venturi effect arising from the relatively shallow angle of the tapering walls and tolerances between the tapering walls and the vent check ball 132 which maintains metering accuracy from the first pour to the last pour.

That is, when the bottle is full a greater amount of air passes through the vent bore 130 to suspend the vent ball 132 higher in the column 134 when the liquid volume decreases. As the liquid volume decreases, the vent air pressure decreases and the vent ball 132 is suspended lower in the column 134, but air pressure is sustained due to the narrowed passage between the tapered walls of the column 134 and the vent ball 132. The prolonged suspension of the vent ball 132 is sustained until the primary check ball 124 migrates to the seat 128. The taper angle and length of the column 134 are selected to assure that the volume dispensed with each pour remains constant over the life of the bottle. The taper of the walls at the column 134 are typically sized in the range of 0.5° to 5° with a length of 0.25 to 0.5 inches.

Figure 4:
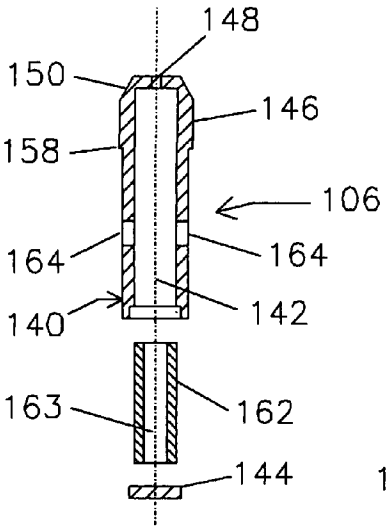
FIG. 4 shows a longitudinal exploded assembly view in cross section to the metering orifice valve of FIG. 2 and a tubular weighting and liquid/air control valve piece.

Supported to the aft end of the dump cap valve assembly 102 is the metering valve piece assembly 106, shown in exploded detail at FIG. 4. The metering valve piece assembly 106 mounts in a dump cap housing or body 156. The valve piece assembly 106 and provides a generally tubular valve piece body 140 having a coextensive bore 142. An aft end of the bore 142 is covered with a closed cap piece 144. A forward valve end 146 of the body 140 includes a longitudinal extending metering orifice or jet 148. The cap piece 144 is fastened to the valve body 140 with interconnecting surfaces, fasteners, adhesive, welding or the like.

A forward, tapered sealing surface 150 of the valve end 146 circumscribes the metering orifice 148 and mates with a complementary, tapered sealing surface 152 formed within a bore 154 of the dump cap body 156. Mating, conical tapered surfaces 150 and 152 are presently provided although other shaped valve/seat configurations can be used to equal advantage. The aft surface of the valve end 146 radiates to define a flange surface 158 that cooperates with one or more projections 160 at the bore 154 to retain the valve piece body 140 to the dump cap body 156. Other mechanisms may be provided to loosely retain the valve assembly 106 to the dump cap body 156.

The valve body 140 is loosely contained to the dump cap assembly 102 for reciprocating movement within the dump cap body 156. When the pourer 100 is tipped to dispense liquid, the surfaces 150 and 152 seal to isolate liquid flow through the dump cap body 156 and bore 154 via the metering orifice 148. When the pourer 100 is returned to an upright condition, the flange 158 rests against the projections 160 and liquid is free to drain through the bore 154, around the valve body 140 and return to the bottle. A small amount of liquid normally collects and is contained in the bore 142.

Mounted within the bore 142 of the valve piece body 140 is a weighted, tubular liquid control shutter or valve piece 162. The liquid control shutter 162 can be solid or tubular or any other shape provided it includes surfaces that cooperate with (i.e. alternately cover and expose) one or more liquid control orifices or apertures 164 that extend through the walls of the valve body 140. The liquid control shutter 162 can be constructed of a variety of materials, composites or several materials. The present tubular shutter 162 is constructed from brass and is supported for unrestricted, reciprocating motion within the bore 142. The tolerances are such that the liquid control shutter 162 moves freely along the walls of the bore 142. The alternate movement extremes of the valve piece body 140 and liquid control shutter 162 relative to the primary check ball 124 and vent ball 132 are depicted in FIGS. 2 and 3.

With the pourer 100 in an upright condition as shown in FIG. 2, the liquid control shutter 162 covers or blocks the liquid control orifices 164 and substantially seals the bore 142 and metering orifice 148 from the liquid. With the pourer 100 tipped to dispense liquid as shown in FIG. 3, the liquid control shutter 162 is displaced forward to expose the liquid control orifices 164 to the flow of liquid in the bottle. Contemporaneously, the valve body surface 150 seals against the dump cap surface 152 to restrict liquid flow entering the primary flow bore 118 downstream of the valve seat 126 to that entering via the metering orifice 148.

A negative or vacuum-like pressure on the downstream side of the check ball 124 (e.g. in a similar fashion to placing a finger over one end of a straw) is initially created by blocking liquid flow to the metering orifice 148 via the shutter piece 162. The negative pressure condition and restriction of liquid flow temporarily prevents movement of the check ball 124, until the shutter piece 162 moves sufficiently to expose the liquid control orifices 164 and thereby the metering orifice to normal liquid flow. Once the control orifices 164 are exposed to liquid flow, the vacuum/negative pressure condition is released. The pressure at the downstream side of the aft seat 126 equalized and returns to being equal to or slightly positive of the pressure on the upstream side of the seat 126. The check ball 124 is then released to move forward at a rate determined by the relative sizes of the metering orifice 148 and liquid control orifice(s) 164 and the concurrent surface tensions and hydraulic interaction between the check ball 124 and the liquid within the flow bore 118. The rate of movement or period of travel between the seats 126 and 128 determines the volume dispensed from the pourer 100.

The mounting and longitudinal alignment of the valve piece body 140 and metering orifice 148 within the flow conduit 108 and the cooperating action of the liquid control shutter 162 thus provides a control mechanism for temporarily holding the check ball 124 at the aft seat 126. The negative or vacuum pressure condition produces retention forces that have particularly proven sufficiently strong to prevent a user from inducing either a "blocked" or "short shot" condition. The small projection 129 cooperates with the temporary, vacuum/negative pressure retention of the check ball 124 to assure the presence of liquid at the port 120 as the air control valve piece 162 moves to release the check ball 124.

That is, any extreme pivoting or rotation of the wrist or other exaggerated whipping or pouring action by itself will not prematurely dislodge the check ball 124. Instead, such actions merely induce liquid to normally enter the inlet port 120 and flow bore 118 when the substantially contemporaneous movement of the liquid control shutter 162 exposes the liquid control orifices 164 to produce a change in pressure that releases the check ball 124 to normally meter the liquid flow.

The reciprocating operation of the valve assembly 106 within the improved dump cap metering assembly 102 has also proven sufficient to prevent any undesired "continuous" pour condition. That is, any tipping action on the pourer 100 that causes the valve body 140 to seal the surfaces 150 and 152, release the shutter piece 162, and expose the liquid control orifices 164, prevents the check ball 124 from sticking or hanging up to produce a "free pour" condition.

With a judicious selection of the relative sizes of the metering orifice 148 and liquid control orifices 164, the size of the bore space 142, the weight and shape of the shutter piece 162 and associated tolerances, precisely metered volumes of liquid can be dispensed from the pourer 100 with each complete tipping cycle.

Figure 6:
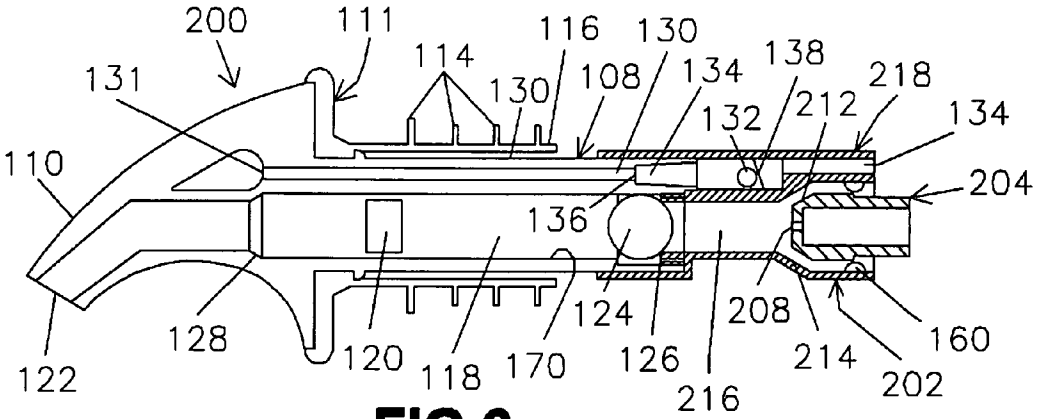
FIG. 6 shows a longitudinal side view to an alternative pourer supporting an improved dump cap shown in partial cutaway with an un-weighted, tubular metering orifice control valve tube and primary and vent check balls retracted.
Figure 7:
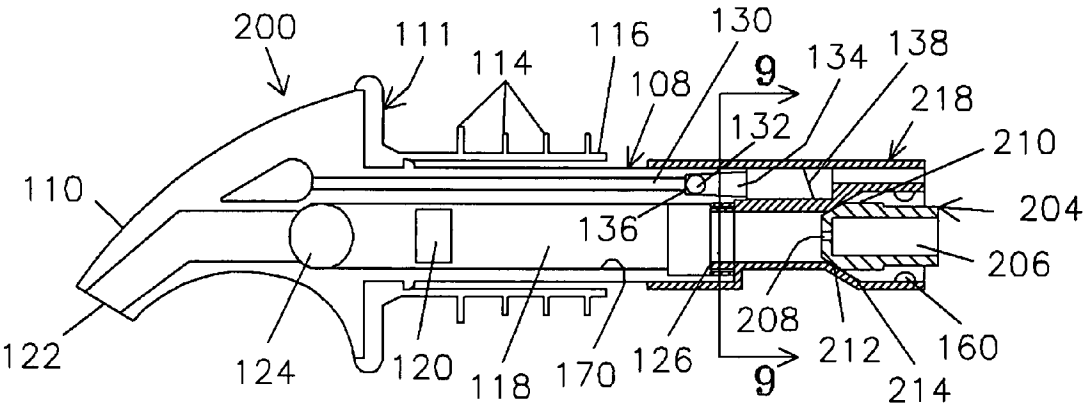
FIG. 7 shows a longitudinal side view to the pourer of FIG. 6 with the un-weighted metering orifice control valve tube and the primary and vent check balls extended and seated to forward valve seats.
Figure 9:
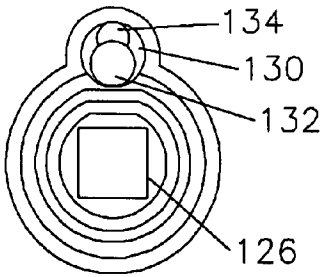
FIG. 9 shows a cross section view through the pourer of FIG. 7 taken along section lines 9-9.
Figure 8:
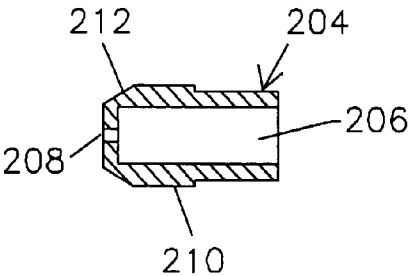
FIG. 8 shows a longitudinal side view to the metering orifice control valve tube of FIG. 6.

With an appreciation of the advantages of the improved pourer 100, attention is directed to FIGS. 6 through 7 which depict a pourer 200 of similar general construction to the pourer 100. The pourer 200 includes an alternative, improved dump cap valve metering assembly 202 that does not have an end cap 144 or shutter piece 162. The valve assembly 202 includes a tubular valve piece body 204, shown in FIG. 8, having a bore 206. A longitudinal metering orifice or jet 208 is formed into a valve end 210 and an open aft end of the bore 206. A tapered sealing surface 212 circumscribes the metering orifice 208 and mates with a sealing surface 214 of complementary shape in a bore 216 of the dump cap body 218. A flanged surface 213 cooperates with projections 160 to retain the valve piece 204 to the body 218. FIG. 9 shows a cross section view through the dump cap body 218 taken along section lines 9-9.

The weight of the one-piece valve body 204 can be varied as desired with a judicious selection of material(s), length and/or configuration of the valve piece body 204. The valve assembly 202, like the valve assembly 106, is configured for reciprocating movement within the bore 216 between the seat surface 214 and retainer projections 160.

As with the pourer 100, the valve assembly 202 provides a longitudinally directed metering orifice 208 coaxially located relative to the primary flow bore 118. With the tipping of the pourer 200, the surfaces 212 and 214 seal and the assembly 202 produces a slight pressure differential between the upstream and downstream sides of the aft seat 126 and across the check ball 124 to temporarily delay movement of the check ball 124 until liquid enters the flow bore 118 via inlet port(s) 120. As liquid impinges on the bore 206, liquid within the bottle is pushed through the valve body bore 206 and metering orifice 208, the check ball 124 is released from the aft seat 126, and a metered volume of liquid is dispensed through the spout 110. With the return of the pourer 200 to an upright condition, the liquid returns to the bottle via the pathways between the conduit 108 and seal walls 116 and the primary flow bore 118 and dump valve body 204. The delay of the check ball 124 is not as significant as the pourer 100 but does improve on the deficiencies of the prior art pourer of FIG. 1 and the sidewall located metering orifice 38.

Figure 10:
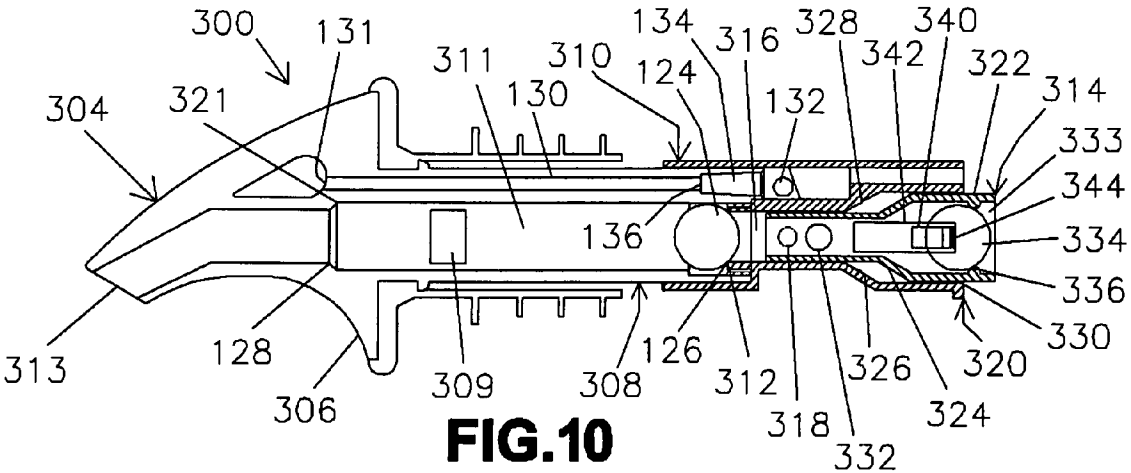
FIG. 10 shows a longitudinal side view to another alternative pourer supporting an improved dump cap shown in partial cutaway with a metering orifice control valve tube having a liquid control orifice and a captured weighted ball and with the weighting ball, primary and vent check balls retracted.
Figure 11:
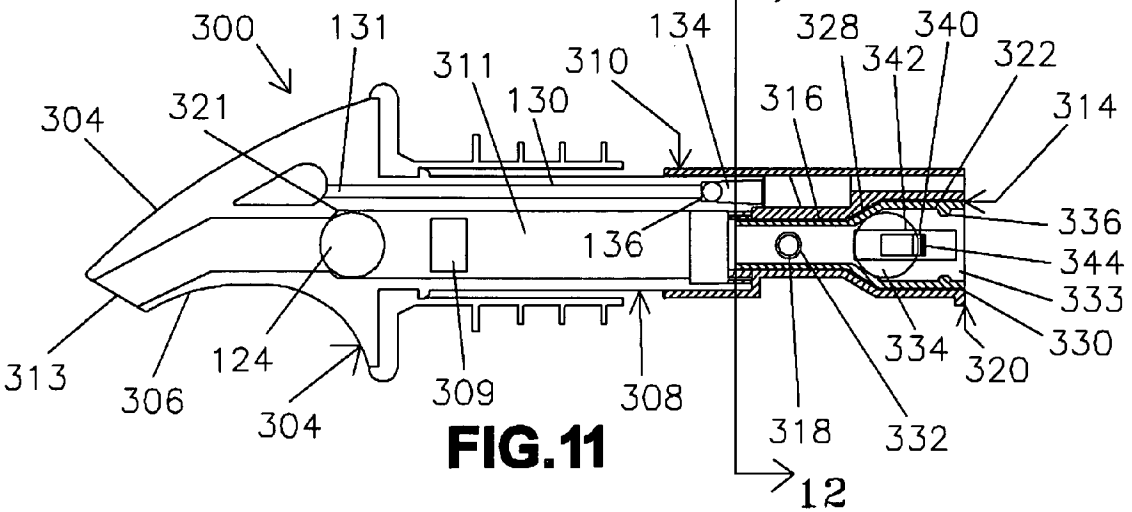
FIG. 11 shows a longitudinal side view to the pourer of FIG. 10 with the metering orifice valve tube, weighting ball and primary and vent check balls seated to forward valve seats.
Figure 12:
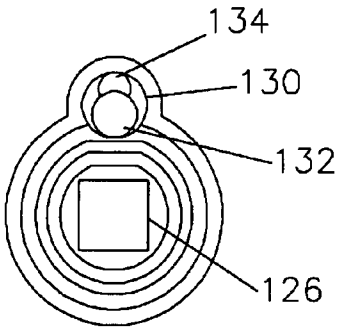
FIG. 12 shows a cross section view through the pourer of FIG. 11 taken along section lines 12-12.

FIGS. 10 and 11 depict another improved pourer 300 in alternative upright and tipped conditions wherein included check ball and valve members are normally displaced to the aft and forward limits of their respective travel ranges. FIG. 12 shows a cross section view through an improved dump cap valve assembly 310 taken along section lines 12-12. The pourer 300 provides a pourer body 304 having a spout 306 and primary flow conduit 308. Primary liquid supply ports 309 are molded into the conduit 308 and communicate with a primary flow bore 311 that terminates at an outlet port 313 of the spout 306

The improved dump cap valve assembly 310 is fastened to an aft end of the primary flow conduit 308 with resilient, flange fasteners 312. A metering valve assembly 314 is supported in a bore 316 of the dump cap assembly 310. The metering valve assembly 314 is mounted for longitudinal reciprocating movement to alternately cover and expose a metering orifice 318 to liquid flow in the bottle. The metering orifice 318 radially extends through a sidewall of the dump cap body 320 relative to a longitudinal flow axis of the primary flow bore 311.

As with the pourer 100, the operation of the metering valve assembly 314 varies a pressure differential on opposite sides of a primary check valve or check ball 124. An initial negative/vacuum pressure condition created by covering or blocking a metering orifice 318 temporarily restrains the primary check ball 124 to the aft seat 126. Upon exposing the metering orifice to equal pressure, normal liquid flow through the metering orifice 318 returns, the negative pressure ceases and the check ball 124 is released to migrate with liquid flow through the primary bore 311 to a forward seat 321 to precisely meter the flow through the pourer 300.

Movement of a tubular valve piece body 322 of the valve assembly 314 alternatively covers and exposes the metering orifice 318 to liquid flow through the valve body 322, see FIG. 10. A pressure or liquid control aperture 332 is formed into the sidewall of the valve piece body 322 to align with or expose the metering orifice 318, see FIG. 11, to liquid flow through the valve piece body 322 to break the negative/vacuum pressure and release the check ball 124. A forward, tapered sealing surface 324 of the valve piece body 322 mates with a sealing surface 326 in the bore 316 of the dump cap body 320. Slight projections 330 from the dump cap body 320 extend into the bore 316 to displace the valve body 322 away from contact with the dump cap body 320 and assure smooth relative movement.

A weighted check ball 334 is mounted in a bore 333 of the valve piece body 322 to enhance movement of the valve body 322. Resilient projections 336 extend from the valve piece body 322 to retain the ball 334 in the valve body 322. The weight and movement of the ball 334 assures uninterrupted, non-sticking movement of the valve body 322 to prevent the nuisance "blocked", "short shot" and "free pour" conditions.

Other resilient projections 344 radially extend from the dump cap body 320 into elongated liquid control orifices 342 formed through the sidewalls of the valve body 322. The resilient projections 344 rest in the liquid control apertures 342 to retain the valve body 322 to the dump cap body 320, assure proper alignment of the aperture(s) 332 with the metering orifice(s) 318, and limit the range of motion of the valve piece body 322. With the alignment of the liquid control aperture 332 to expose the metering orifice 318, the liquid control apertures 342 admit liquid to the bore 333 to break the negative/vacuum pressure at the downstream side of the aft seat 126 and check ball 124.

FIGS. 13 through 16 depict still other alternative pourers 400, 500, 600 and 700 wherein improved valve assemblies have been combined with a suitable pourer body (e.g. 108 or 308) to temporarily restrain a primary check ball to prevent the nuisance "blocked", "short shot" and "free pour" conditions. The associated pourer bodies are shown foreshortened and at a reduced scale to the metering valve assemblies. Each pourer body provides a primary flow bore, primary access port, a parallel vent bore, pour spout and associated valve seats for included valve pieces in fashions similar to the pourers 100, 200 and 300. The metering valve assembly of each pourer is configured to temporarily control a pressure differential on a downstream side of an aft seat (not shown) that supports and limits movement of a check ball or any other suitable valve piece that reciprocates between open and closed conditions at the primary flow bore to regulate and/or meter liquid flow through the pourer.

Figure 13:
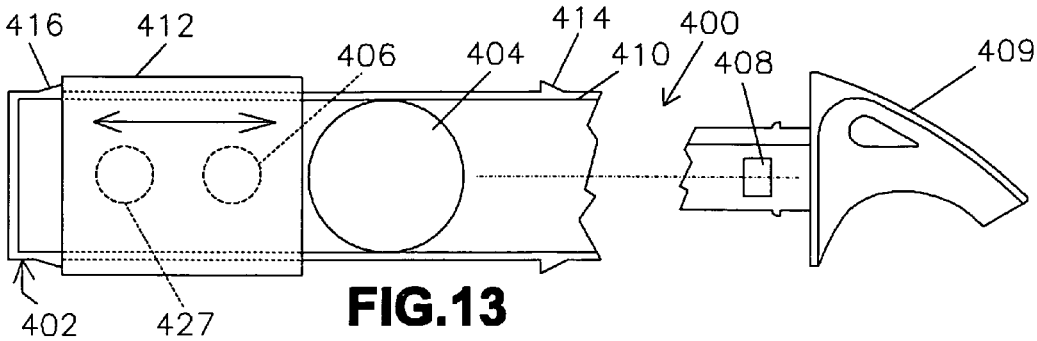
FIG. 13 shows a longitudinal foreshortened side view to another alternative pourer wherein the exposure of a side wall metering orifice is controlled with a sleeve mounted for reciprocating motion relative to a side wall metering orifice to cover and expose the metering orifice and wherein the sleeve is shown retracted to cover the metering orifice and wherein a further aligning aperture is shown.

FIG. 13 depicts a foreshortened view to a generalized alternative pourer 400 having a flow conduit 402 that contains an internal check valve 404 (e.g. ball bearing) that reciprocates between an aft seat (not shown) located forward of a metering orifice 406 and a forward seat (not shown) located forward of an input port 408 at a spout 409 to a primary flow bore 410. A shutter piece 412 (e.g. tubular sleeve) is mounted along an outer surface of the flow conduit 402 and is restrained to move between fore and aft limits 414 and 416. The shutter piece reciprocates between the limits 414 and 416. The limits 414 and 416 can comprise ridges or flanges as depicted or a mating slot in the shutter piece 412 and resilient projection that projects from the conduit 402 to restrain longitudinal travel, among other possible stops.

Movement of the shutter piece 412 alternatively covers and exposes the metering orifice 406 to release the check ball 404 and permit liquid flow from the flow bore 410 downstream of the check ball 404 through the metering orifice 406. Alternatively, a pressure relief aperture 427 (shown in dashed line) can be formed into the shutter piece 412 to align with the metering orifice 406. With the exposure of the metering orifice 406 to liquid flow through the primary flow bore 410 and metering orifice 406, a negative/vacuum pressure condition is broken on the downstream side of check ball 404 and the check ball 404 is free to move thereby preventing the nuisance "blocked", "short shot" and "free pour" conditions.

Figure 14:
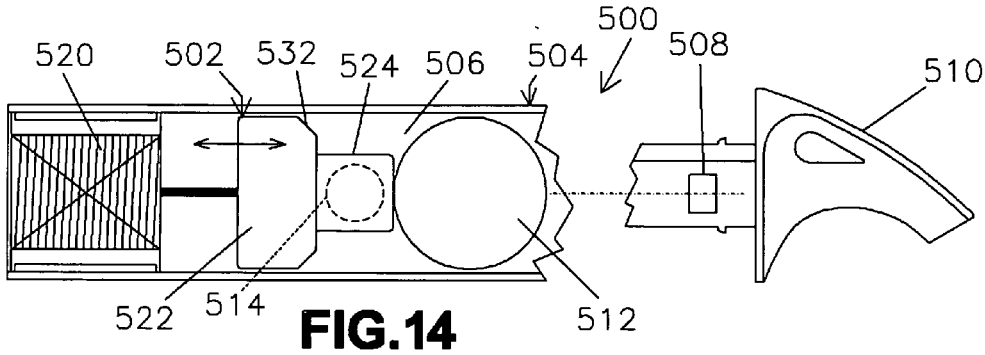
FIG. 14 shows a longitudinal foreshortened side view to another alternative pourer wherein the exposure of a side wall metering orifice is controlled with an electromagnetically controlled solenoid valve piece that longitudinally extends and retracts to cover and expose the metering orifice and wherein the valve piece is shown extended to cover the metering orifice.

FIG. 14 shows a foreshortened longitudinal view in partial cutaway to another pourer 500 including an alternative generalized volumetric valve metering assembly 502 fitted to a primary flow conduit 504. The conduit 504 includes a primary flow bore 506, a liquid inlet port 508, a spout 510, and a valve member 512 (e.g. a check ball). The valve member 512 moves between mating surfaces or seats located forward of a metering orifice 514 and forward of the inlet port 508 to precisely meter liquid flow through the spout 508 as with the spouts 100-300.

Release of the valve member 512 from the aft seat is determined by an electromagnetically controlled release assembly 502 (e.g. solenoid assembly) that alternately covers and exposes the metering orifice 514. The solenoid controlled assembly 502 includes a DC powered electromagnet 520. A plunger or stem piece 522 supports a cover piece 524 having a surface that longitudinally reciprocates between positions that either cover or expose the metering orifice 514.

With the tipping of a bottle horizontal, the valve assembly 502 blocks the metering orifice 514 to temporarily restrain the check ball 512. As liquid enters the inlet port 508, the assembly exposes the metering orifice 514 to release the check ball 512 which migrates at a controlled rate until it contacts the forward seat to terminate liquid flow. With a subsequent tipping of the bottle to an upright position, the valve piece 512 retracts to cover the metering orifice 514 and un-poured liquid returns to the bottle.

An internal vent assembly (not shown, but for example such as described above for the pourers 100, 200 or 300) can be included to prevent dripping at the spout 508. The valve piece 522 might also be constructed of a permanent magnet material to cycle to and fro with a changing polarity at the electromagnet 520

Figure 15:
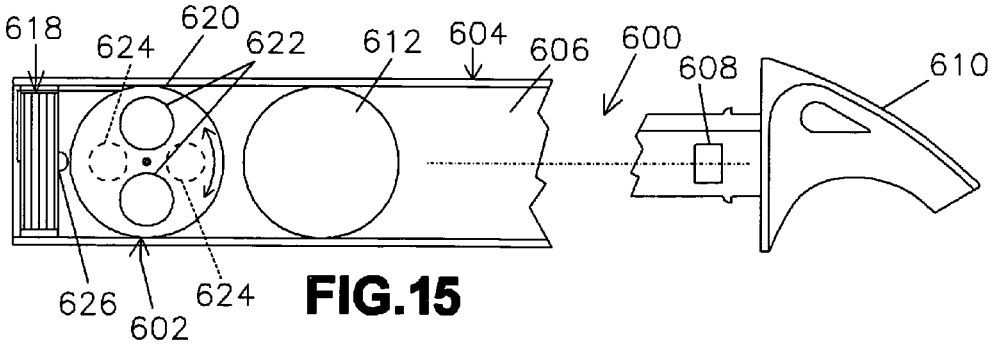
FIG. 15 shows a longitudinal foreshortened side view to another alternative pourer wherein the exposure of a side wall metering orifice(s) is controlled with an electromagnetically controlled rotary valve piece that rotates to cover and expose the metering orifice and wherein the valve piece is shown rotated to cover the metering orifice(s).

FIG. 15 shows a foreshortened longitudinal view in partial cutaway to another pourer 600 including another alternative improved volumetric valve metering assembly 602 fitted to a primary flow conduit 604. The conduit 604 includes a primary flow bore 606, a liquid inlet port 608, a spout 610, and a valve member 612 (e.g. a check ball). The valve member 612 moves between mating surfaces or seats forward of one or more metering orifice(s) 624 and forward of the inlet port 608 to precisely meter liquid flow in the conduit 604 and through the spout 610.

With the tipping of a bottle horizontal, the valve assembly 602 temporarily blocks the metering orifice(s) 624 to produce a pressure differential to temporarily restrain the check ball 612. As liquid enters the inlet port 608, the valve assembly 602 exposes the metering orifice(s) 624 to equalize the upstream and down stream pressures, which releases the check ball 612 to migrate at a controlled rate until it contacts the forward seat to terminate liquid flow.

Release of the valve member 612 from the aft seat is determined by an electromagnetically controlled valve assembly 618 and rotating shutter plate or disk 620. The shutter plate 620 provides one or more liquid control aperture(s) 622 that alternately cover and align to expose one or more metering orifices 624 formed through the sidewalls of the flow conduit 604. The valve assembly 618 includes a DC powered electromagnet 626 that operates to rotate the plate 620 to cover and expose the metering orifice(s) 624 to liquid via the liquid control apertures 622. A mechanical linkage can couple the electromagnet 626 to rotate the disk piece 626. Alternatively, changing polarities at the electromagnet 618 relative to polarized regions of the rotating disk 20 can be adapted to control rotation of the disk 626.

A subsequent rotation of the bottle to an upright condition causes liquid to return to the bottle. When the valve member 612 returns to the aft seat, the disk 620 is rotated to cover the metering orifice(s) 624 to maintain a negative pressure differential between the downstream and upstream sides of the valve member 612. An internal vent assembly (not shown, but for example such as described for the pourers 100, 200 or 300) might also be included to prevent dripping at the spout 610.

Figure 16:
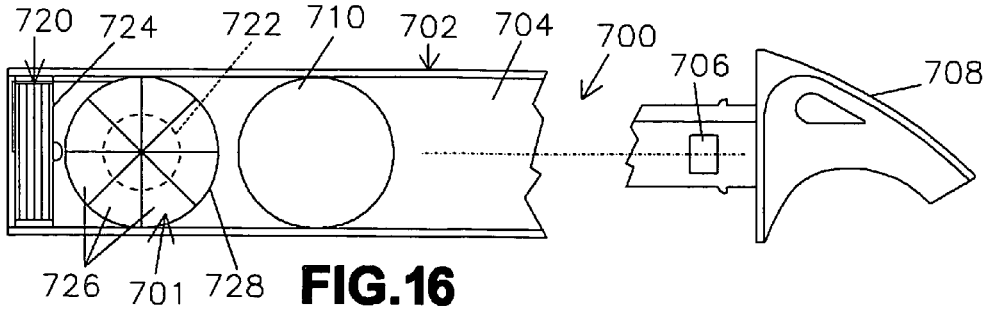
FIG. 16 shows a longitudinal foreshortened side view to another alternative pourer wherein the exposure of a side wall metering orifice is electromagnetically controlled with overlapping plates that collapse and dilate like a camera shutter to cover and expose the metering orifice and wherein the plates are shown collapsed or pivoted to cover the metering orifice.

FIG. 16 shows a foreshortened longitudinal view in partial cutaway to another pourer 700 including another alternative improved volumetric valve metering assembly 701 fitted to a primary flow conduit 702. The flow conduit 702 includes a primary flow bore 704, a liquid inlet port 706, a spout 708, and a valve member 710 (e.g. a check ball). The valve member 710 moves between mating aft and forward sealing surfaces or seats (not shown) to precisely meter liquid flow through the spout 708.

Release of the valve member 710 is determined by an electromagnetically controlled rotating shutter assembly 720 that alternately covers and exposes one or more metering orifices 722. The shutter assembly 720 includes a DC powered electromagnet 724. Several overlapping, pivoting leaflets 726 of a shutter piece 728 are mounted to pivot in a fashion similar to a camera shutter. The leaflets cyclically pivot to define a central liquid control aperture of a sufficient diameter to expose the metering orifice 722, equalize pressure and permit normal liquid flow there through. The shutter piece 728 thus alternately covers and exposes the metering orifice 722.

The leaflets 726 can be adapted to expand and contract via a resiliently biased mechanical linkage. Polarized regions of the leaflets 726 might also be adapted to interact with the field of the electromagnet 724 to pivot to expose the metering orifice 722.

With the tipping of a bottle horizontal, the valve assembly 701 temporarily blocks the metering orifice 722 to produce a pressure differential to temporarily restrain the check ball 710. As liquid enters the inlet port 706, the shutter 728 is engaged to expose the metering orifice 722, equalize pressure and to release the check ball 710 to migrate at a controlled rate until it contacts the forward seat 714 to terminate liquid flow.

A subsequent rotation of the bottle upright causes liquid to return to the bottle. When the valve member 710 returns to the aft seat, the electromagnet 724 manipulates the leaflets 726 to maintain a negative pressure differential between the downstream and upstream sides of the valve member 710. An internal vent assembly (not shown, but for example such as described for the pourers 100, 200 or 300) might also be included to prevent dripping at the spout 610.

From the foregoing discussion to several alternative pourers with improved liquid metering control, it is apparent that a pourer including the invention can be constructed in many different configurations. Many different valve assemblies can be adapted to temporarily control the movement of a primary valve assembly and/or valve piece in a volumetrically metered pourer to prevent nuisance "blocked", "short shot" and "free pour" conditions. The valve assemblies can also be adapted to other valve pieces to produce a desired pressure differential at either the downstream or upstream sides of either a normally open or normally closed valve piece.

Figure 17:
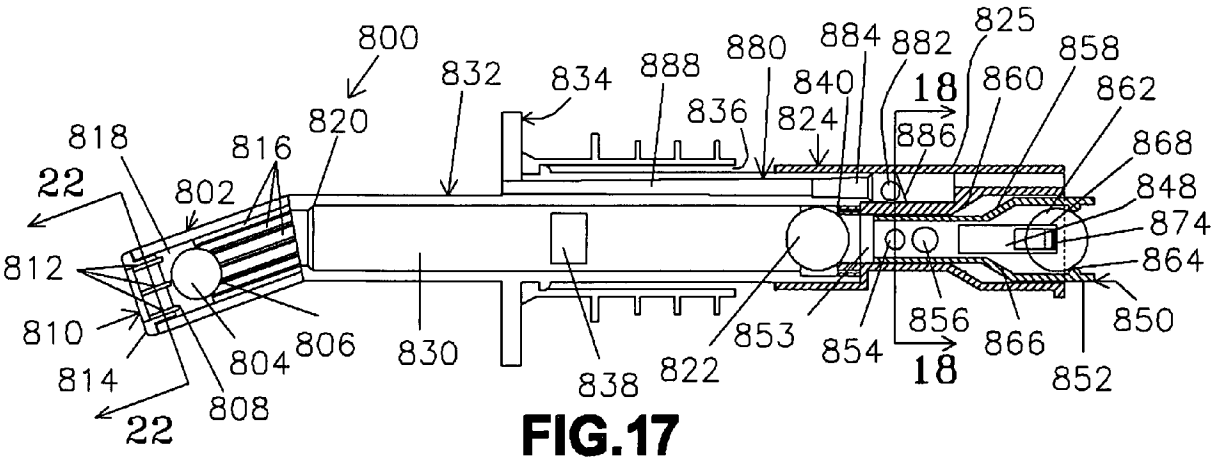
FIG. 17 shows a longitudinal side view to another alternative pourer similar to the pourer of FIG. 10 supporting an improved dump cap shown in partial cutaway with a metering orifice control valve tube with a weighted ball and primary and vent check balls retracted and further supporting a retracted spout check ball between a plurality of integral ribs and a removable grated cap piece.
Figure 19:
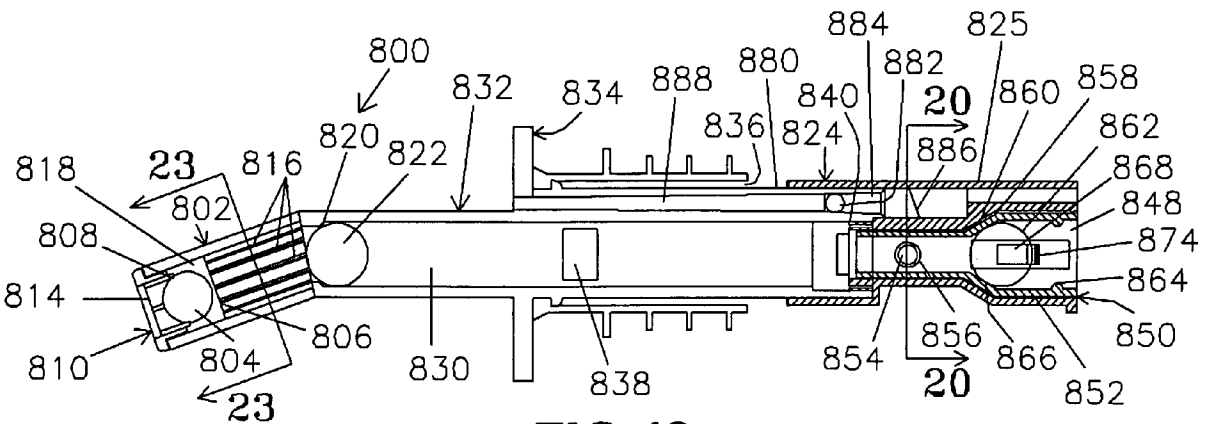
FIG. 19 shows a longitudinal side view to the pourer of FIG. 17 with the metering orifice control valve tube and the primary, vent check and spout check balls seated to forward seats.

Still another pourer 800 that exhibits still other improvements is shown and described below with respect to FIGS. 17 though 23. The pourer 800 includes an improved, integrally formed spout cover assembly 802 that can be used alone or with any of the pourers described herein to cover any pouring conduit against external contaminants. The pourer 800 is similar to the pourer 300 of FIGS. 10 and 11 but is improved by fitting a ball valve controlled spout cover assembly 802 to the spout. The spout cover assembly 802 can include a check valve piece 804 (e.g. ball). When constructed with a valve piece 804, the valve piece 804 is contained between an aft seat 806 and a porous forward seat 808 at a cover or cap piece 810 fitted to the spout.

Figure 22:
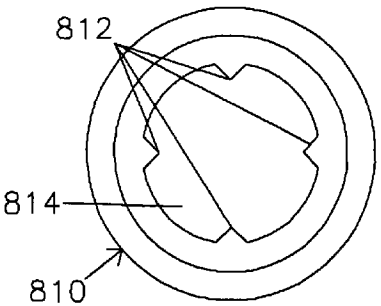
FIG. 22 shows a cross section view through the cover piece of the pourer of FIG. 17 taken along section lines 22-22.

With attention to the cross section view of FIG. 22 and for a pourer fitted with a valve piece 804, the forward seat 808 is defined by a number of fins 812 that radially project inward from the sidewalls of the cover piece 810. The bore of the cover piece 810 can be left open or a flat, porous grate or screen-like front cap piece 814 can be fitted to the cover piece 810 to permit liquid to flow out of the pourer 800 but restrict the admission of insects etc.

The radially directed fins 812 are shaped and/or arranged to define a curved, hemi-spherical seat 808 at the downstream or aft ends of the fins 812 to support the check ball valve piece 804. Liquid can flow around the check ball 804 through either the open bore or the grated cap piece 814. It is presently contemplated that if the valve piece 804 is not used, the ribbed seats 806 and 808 can be deleted.

Figure 23:
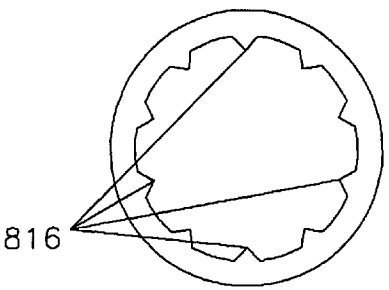
FIG. 23 shows a cross section view through the spout of the pourer of FIG. 19 21 taken along section lines 23-23.
Figure 21:
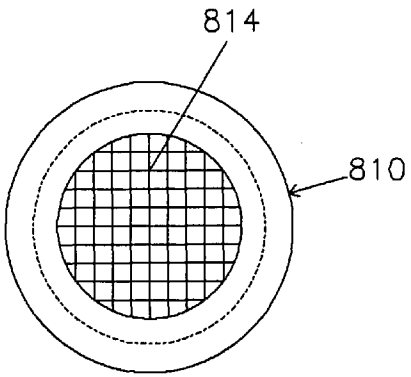
FIG. 21 shows an end view to a cover or cap piece fitted to the pour spout of FIGS. 17 and 18 and wherein a porous grate or matrix shape is exhibited.
Figure 18:
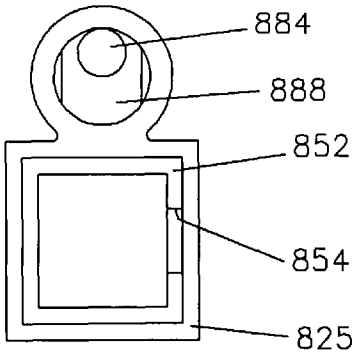
FIG. 18 shows a cross section view through the metering orifice of the pourer of FIG. 17 taken along section lines 18-18.
Figure 20:
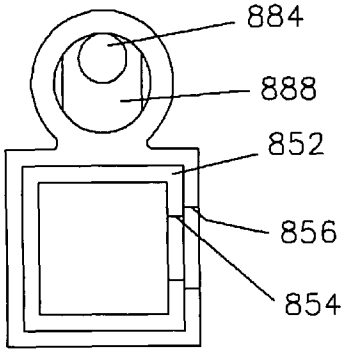
FIG. 20 shows a cross section view through the metering orifice of the pourer of FIG. 19 taken along section lines 20-20.

With attention to the cross section view of FIG. 23, the aft seat 806 is defined by several fins or projections 816 that radially project inward along the interior wall of a spout bore 818. The forward ends of the fins 816 are longitudinally offset to define a hemi-spherical seat 806 downstream of the valve piece 804. The aft ends of the fins 816 might also be longitudinally offset to form the forward valve seat 820 for a primary check valve member 822. The fins 816 are integrally molded into the bore 818, although could be constructed as a separate insert piece.

With additional attention to FIGS. 17 through 20 views are shown to the pourer 800 which is similar to the pourer of FIG. 10. The primary valve member 822 is contained in a flow bore 830 of a primary flow conduit 832 and is shown at its travel extremes in respective upright and tipped conditions at FIGS. 17 and 19. A flexible seal member 834 is mounted along the longitudinal length of the flow conduit 832. Upon tipping a bottle to which the pourer 800 is attached, liquid enters a channel space 836 between the seal 834 and conduit 832 and is directed to a primary inlet port 838. The primary inlet port 838, in turn, directs the liquid through the bores 830 and 818, around the valve member 804 and out the cover piece 810.

During tipping and once the pressure differential at the primary check valve piece 822 is released from a rear seat 840, the primary check valve piece 822 migrates at a controlled rate to the forward seat 820, where the valve member 822 seals-off further flow. With the return of the bottle to an upright condition, the valve member 822 returns to the aft seat 840 at the metering dump cap assembly 824.

Trapped liquid is returned to the bottle upon passing through the bore 848 of a reciprocating valve assembly 850 having a tubular valve body 852. The valve body 852 reciprocates to and fro in a bore 853 of the dump cap body 825 to respectively cover a metering orifice 854 with the valve body 852 or align a liquid control orifice 856 with the metering orifice 854. Tapered valve surfaces 858 and 860 at the valve body 852 and dump cap body 825 cooperate with the exposure of the metering orifice 854 to admit air through the metering orifice 854 to break a negative/vacuum pressure condition at the downstream side of the check valve piece 822 and release the check valve piece 822 from the rear seat 840 to initiate metering of the liquid.

A weighted valve member or check ball 862 reciprocates between aft retainer projections 864 and a forward seat 866 in the bore 848. The weight of the ball 862 enhances the to and fro movement of the valve body 852. The valve body 852 is secured to the dump cap body 825 at a slot or air control window 868 in the valve body 852. A flange 874 that resiliently projects from the dump cap body 825 mounts in the liquid control window 868. The flange 874 retains the valve body 852 to the dump cap body 825 and limits and guides the relative movement of the valve body 852 within the dump cap body 825. The concentric square cross sectional shapes of the valve bodies 825 and 852 also maintain proper relative alignment, reference FIGS. 18 and 20.

A vent assembly 880 is also provided to prevent liquid from dripping out of the pour spout 802. A vent valve piece 882 reciprocates between forward and aft seats 884 and 886 defined in the primary flow conduit 832 and dump cap assembly 824 to expose a vent bore 888 to the atmosphere when the pourer 800 is upright and block the vent bore 88 when the pourer 800 is tipped. The vent valve piece 882 is supported within a shallow tapered bore 884 and as with the above pourers 100-400 operates to prevent dripping at the spout and self regulate the suspension of the vent ball 882 from the first to the last pours with progressively reducing liquid volume.

While the invention has been described with respect to several presently preferred assemblies and several considered improvements, modifications and/or alternatives thereto, still other pourer assemblies, valve pieces and combinational arrangements may be suggested to those skilled in the art. It is also to be appreciated that the features of the foregoing pourers can be arranged in different combinations or may be used alone. For example, any of the described metering orifice control valve assemblies can be adapted to cooperate with one or more metering orifices provided in a pourer. A variety of different primary, dump cap and vent valve members can also be combined and mounted to cooperate with each other to meter and terminate liquid flow, to control the return of liquid to the bottle, to prevent dripping, and to prevent nuisance "blocked", "short shot" and "free pour" conditions. The integrally molded valve spout cover assembly can also be integrated into any type of pourer. The foregoing description should therefore be construed to include all those embodiments within the spirit and scope of the following claims.

What is claimed is:

1. Liquid metering apparatus for a bottle containing a liquid comprising:

a) a pourer body containing a tubular flow conduit having a flow bore, wherein the flow bore communicates with a liquid inlet port located between a dispensing port and a return port, wherein the inlet and return ports are located to mount in a bottle and the dispensing port mounts external to the bottle;

b) a primary valve piece mounted in said flow bore for reciprocating motion between forward and aft valve seats respectively located upstream and downstream of said inlet port to direct liquid between said inlet port, said dispensing port and said return port;

c) a metering orifice located downstream of said aft valve seat to regulate hydraulic movement of said primary valve piece in said flow bore; and d) a pressure control assembly having a control valve piece responsive to rotation of said pourer body relative to an inclined position where liquid enters the inlet port to vary a pressure condition downstream of said metering orifice such that said primary valve piece is restrained to said aft valve seat by a first pressure established at a rotation angle before said inclined position and is released when said control valve piece is manipulated to establish a second pressure equal to or greater than the first pressure at or past said inclined position to meter liquid flow through the pourer.

2. Liquid metering apparatus as set forth in claim 1 wherein said pressure control assembly includes a valve body mounted to said flow conduit and having a control orifice located downstream of said aft valve seat and wherein said control valve piece is mounted for reciprocating movement in said valve body to cover said control orifice to establish said first pressure condition and to expose said control orifice when rotated to said inclined position to establish the second pressure condition.

3. Liquid metering apparatus as set forth in claim 2 wherein said metering orifice is formed in said control valve piece and cooperates with liquid flow through said control valve piece to establish said first and second pressures.

4. Liquid metering apparatus as set forth in claim 2 wherein said metering orifice is formed in said control valve piece, wherein said control orifice is formed through a wall of said control valve piece and wherein a shutter member exhibiting a relatively heavy weight versus said control valve piece is mounted for reciprocating motion relative to said control valve piece to alternately cover and expose said control orifice during a rotation of said pourer body.

5. Liquid metering apparatus as set forth in claim 2 wherein said control valve piece comprises a tubular member having a bore and including a seal surface that mates in liquid tight engagement to a surface of said flow bore, wherein said metering orifice is formed in said control valve piece and communicates with the bore of said control valve piece upstream of the seal surface, wherein said control orifice is formed through a wall of said control valve piece, and wherein a tubular shutter member of a relatively heavy weight versus said control valve piece is mounted for reciprocating motion in the bore of said control valve piece to alternately cover and expose said control orifice.

6. Liquid metering apparatus as set forth in claim 5 wherein said valve piece is cylindrical and includes a cover mounted to seal an opening to the bore of said control valve piece and retain said shutter member to said control valve piece.

7. Liquid metering apparatus as set forth in claim 5 wherein said control valve piece comprises a tubular member having a bore and including a seal surface that mates in liquid tight engagement to a surface of said flow bore, wherein said metering orifice communicates with the bore of said control valve piece upstream of said seal surface, and wherein the bore of said control valve piece is exposed to liquid flow during dispensing and return flow through the flow bore.

8. Liquid metering apparatus as set forth in claim 1 wherein said first pressure respectively comprises a negative pressure condition on the downstream side of said aft valve seat and said second pressure comprises an equal or positive pressure condition on the downstream side of said aft valve seat relative to the upstream side of the aft valve seat.

9. Liquid metering apparatus as set forth in claim 1 wherein said metering orifice communicates through a wall of said flow conduit with the flow bore, wherein said pressure control assembly includes a valve body having a valve bore coaxially aligned to said flow bore, wherein a control valve piece is mounted for reciprocating movement in the valve bore, wherein a control orifice extends through a wall of said control valve piece, wherein said control valve piece is located to cover said metering orifice to establish said first pressure and upon rotation of said pourer body to the inclined position to align the control orifice with and expose said metering orifice to liquid flow to establish said second pressure.

10. Liquid metering apparatus as set forth in claim 9 wherein said control valve piece comprises a cylindrical member having a cavity space and including a tapered seal surface that mates in liquid tight relation to a tapered surface of said flow bore and a cap, wherein said metering orifice extends through a wall of said valve piece upstream of said seal surface, wherein a control orifice is formed to communicate through a side wall of said control valve piece within said cavity space, and wherein a shutter member exhibiting a relatively heavy weight versus said control valve piece is mounted for reciprocating motion in the cavity space to alternately cover and expose said control orifice to liquid flow.

11. Liquid metering apparatus as set forth in claim 1 wherein said metering orifice communicates through a wall of said flow conduit with the flow bore, wherein said pressure control assembly includes a control valve piece aligned for reciprocating longitudinal movement relative to said flow bore, wherein said control valve piece includes a surface aligned to cover said metering orifice to establish said first pressure and when the pourer body is rotated to or past said inclined position to expose said metering orifice to liquid flow to establish said second pressure.

12. Liquid metering apparatus as set forth in claim 1 wherein said metering orifice communicates through a wall of said flow conduit with the flow bore, wherein said pressure control assembly includes a valve body mounted to said flow conduit, wherein a control valve piece is mounted for reciprocating movement in a cavity space of said valve body, wherein said control valve piece includes a surface aligned to cover said metering orifice to establish said first pressure and when the pourer body is rotated to said inclined position to align expose said metering orifice to establish said second pressure and liquid flow through the flow bore.

13. Liquid metering apparatus as set forth in claim 11 including an electromagnet mounted to control movement of said control valve piece.

14. Liquid metering apparatus as set forth in claim 13 wherein said valve piece is mounted for reciprocating longitudinal movement.

15. Liquid metering apparatus as set forth in claim 12 wherein said control valve piece is mounted for reciprocating rotary movement in said cavity space and includes a control orifice that rotates between a covering condition to cover said metering orifice and establish said first pressure and when the pourer body is rotated to said inclined position to align with and expose said metering orifice to establish said second pressure and liquid flow through the flow bore.

16. Liquid metering apparatus as set forth in claim 12 wherein said valve piece comprises a plurality of plates mounted to pivot between a configuration covering said metering orifice to establish said first pressure condition and when the pourer body is rotated to said inclined position to pivot to form an orifice aligned to expose said metering orifice liquid flow to establish said second pressure condition and liquid flow through the flow bore.

17. Liquid metering apparatus as set forth in claim 1 including a cover having a cap piece mounted to said dispensing port comprising a plurality of first projections that project into said flow bore adjacent said dispensing port, a plurality of second projections displaced from said first projections and extending from the walls of said flow conduit, and a ball mounted between said first and second projections to permit liquid flow through the dispensing port when the ball contacts the first projections and to seal the flow bore when the ball contacts the second projections.

18. Liquid metering apparatus as set forth in claim 11 wherein said pourer includes a vent conduit having a vent bore exposed at one end to ambient air and at an opposite end to the inside of a bottle, wherein said vent bore includes an elongated declining tapered portion that extends in a range between 0.5° to 5° between upstream and downstream seats, and including a vent valve piece is mounted for reciprocating movement in said tapered portion between said upstream and downstream seats such that said vent valve piece is suspended in said tapered portion for progressively longer periods as the volume of liquid in said bottle diminishes to maintain the delivery of a constant liquid volume with each pour.

19. Liquid metering apparatus for a bottle containing a liquid comprising:

a) a pourer body containing a tubular flow conduit having a flow bore, wherein the flow bore communicates with a liquid inlet port located between a dispensing port and a return port, wherein the inlet and return ports are located to mount in a bottle and the dispensing port mounts external to the bottle;

b) a primary valve piece mounted in said flow bore for reciprocating motion between forward and aft valve seats respectively located upstream and downstream of said inlet port to direct liquid between said inlet port, said dispensing port and said return port; and c) a pressure control assembly having a control valve piece containing a metering orifice mounted for reciprocating movement and responsive to rotation of said pourer body relative to an inclined position where liquid enters the inlet port to vary a pressure condition downstream of said aft valve seat such that said primary valve piece is restrained to said aft valve seat by a first pressure established at an upright position or a rotation angle less than said inclined position and released when said control valve piece is manipulated to establish a second pressure equal to or greater than the first pressure at or past said inclined position to release said primary valve piece and to meter liquid flow through the pourer.

20. Liquid metering apparatus as set forth in claim 19 wherein said pressure control assembly includes a valve body mounted to said flow bore and having a control orifice located downstream of said aft valve seat and a cavity space and wherein said control valve piece is mounted for reciprocating movement in said cavity space to cover said control orifice to establish said first pressure and to expose said control orifice when rotated to said inclined position to establish said second pressure.

21. Liquid metering apparatus as set forth in claim 20 wherein said control valve piece comprises a tubular member having a bore and including a seal surface that mates in liquid tight engagement to a surface of said flow bore, wherein said metering orifice is formed in said control valve piece and communicates with the bore of said control valve piece upstream of the seal surface, wherein said control orifice is formed through a wall of said control valve piece, and wherein a shutter member of a relatively heavy weight versus said control valve piece is mounted for reciprocating motion in the bore of said control valve piece to alternately cover and expose said control orifice to respectively establish said first and second pressures.

22. Liquid metering apparatus as set forth in claim 21 wherein said pourer includes a flow conduit, wherein said metering orifice extends through a wall of said flow conduit to said flow bore, wherein said pressure control assembly includes a valve body mounted to said flow conduit, wherein a control valve piece is mounted for reciprocating movement in a bore of said valve body, wherein the control valve piece includes a seal surface that mates in liquid tight engagement to a surface of said flow bore, wherein said valve piece includes a surface mounted to cover said metering orifice to establish said first pressure condition and when rotated to said predetermined inclined condition to expose said metering orifice to establish said second pressure condition and liquid flow through the flow bore.

23. Liquid metering apparatus as set forth in claim 19 wherein said pourer includes a vent conduit having a vent bore exposed at one end to ambient air and at an opposite end to the inside of a bottle, wherein said vent bore includes an elongated declining tapered portion that extends in a range between 0.5° to 5° between upstream and downstream seats, and including a vent valve piece is mounted for reciprocating movement in said tapered portion between said upstream and downstream seats such that said vent valve piece is suspended in said tapered portion for progressively longer periods as the volume of liquid in said bottle diminishes to maintain the delivery of a constant liquid volume with each pour.

24. Liquid metering apparatus as set forth in claim 23 wherein said vent valve piece comprises a ball.

25. Liquid metering apparatus as set forth in claim 19 including a cover having a cap piece mounted to said dispensing port comprising a plurality of first projections that project into said flow bore adjacent said dispensing port, a plurality of second projections displaced from said first projections and extending from the walls of said flow conduit, and a ball mounted between said first and second projections to permit liquid flow through the dispensing port when the ball contacts the first projections and to seal the flow bore when the ball contacts the second projections.

26. A method for dispensing liquid comprising:

a) mounting a pourer body containing a tubular flow conduit having a flow bore to a bottle, wherein the flow bore communicates with a liquid inlet port located between a dispensing port and a return port, and wherein the inlet and return ports are mounted in the bottle and the dispensing port is mounted external to the bottle;

b) rotating said bottle such that a primary valve piece mounted in said flow bore moves to and fro between forward and aft valve seats respectively located upstream and downstream of said inlet port to direct liquid between said inlet port, said dispensing port and said return port; and c) wherein rotation of said bottle manipulates a pressure control assembly in said pourer body having a control valve piece containing a metering orifice to pivot back and forth relative to an inclined position where liquid enters the inlet port to vary a pressure condition downstream of said aft valve seat such that said primary valve piece is restrained to said aft valve seat by a first pressure established at an upright bottle position or a bottle rotation angle less than said inclined position and is released when said control valve piece is manipulated to establish a second pressure equal to or greater than the first pressure as the bottle is rotated to or past said inclined position to release said primary valve piece to meter liquid flow through the pourer.

27. A method as set forth in claim 26 wherein said pressure control assembly includes a valve body mounted to said flow bore and having a control orifice located downstream of said aft valve seat and a cavity space and wherein said control valve piece reciprocates back and forth in said cavity space to cover said control orifice to establish said first pressure and to expose said control orifice when rotated to said inclined position to establish said second pressure.

28. A method as set forth in claim 26 wherein said control valve piece comprises a tubular member having a bore and including a seal surface that mates in liquid tight engagement to a surface of said flow bore, wherein said metering orifice is formed in said control valve piece and communicates with the bore of said control valve piece upstream of the seal surface, wherein said control orifice is formed through a wall of said control valve piece, and wherein a shutter member of a relatively heavy weight versus said control valve piece reciprocates back and forth in the bore of said control valve piece to alternately cover and expose said control orifice to respectively establish said first and second pressures.

* * * * *